US005494553A

United States Patent [19]

Colucci

[11] Patent Number: 5,494,553

[45] **Date of Patent: *Feb. 27, 1996**

[54] MULTI-PURPOSE CLAMPING APPARATUS

[76] Inventor: William G. Colucci, 1370 Park Ave., Long Beach, Calif. 90804

[ * ] Notice: The term of this patent shall not extend beyond the expiration date of Pat. No. 5,401,354.

[21] Appl. No.: 354,499

[22] Filed: Dec. 12, 1994

Related U.S. Application Data

[63] Continuation-in-part of Ser. No. 123,874, Sep. 20, 1993, Pat. No. 5,401,354.

[51] Int. Cl.[6] ..... B30B 15/00

[52] U.S. Cl. ..... 156/580; 269/6; 269/37; 269/41; 269/93

[58] Field of Search ..... 156/526, 580; 269/6, 37, 41, 93

[56] References Cited

U.S. PATENT DOCUMENTS

| | | | |
|---|---|---|---|
| 1,016,594 | 2/1912 | Woodman | 144/84 |
| 1,073,549 | 9/1913 | Wagner | 269/140 |
| 1,125,253 | 1/1915 | Barber | 29/256 |
| 1,766,230 | 6/1930 | Sea | 269/246 |
| 1,973,238 | 9/1934 | Walter | 269/101 |
| 2,572,366 | 10/1951 | McGough | 269/165 |
| 2,896,300 | 7/1959 | Arrighini et al. | 249/194 |
| 2,941,557 | 6/1960 | Baprawski | 269/41 |
| 3,603,580 | 9/1991 | Van Gelder | 269/42 |
| 3,888,476 | 6/1975 | Barton | 269/41 |
| 4,421,591 | 12/1983 | DeLight | 156/502 X |
| 4,475,726 | 10/1984 | Smith | 269/41 |
| 4,552,345 | 11/1985 | Benda et al. | 269/43 |
| 4,647,028 | 3/1987 | Yang | 269/139 |
| 4,753,426 | 6/1988 | Varkala | 269/53 |
| 4,926,722 | 5/1990 | Sorensen et al. | 81/487 |
| 4,995,935 | 2/1991 | Ganzberger | 156/499 |
| 5,005,449 | 4/1991 | Sorensen et al. | 81/152 |
| 5,135,207 | 8/1992 | Bleaney | 269/21 |
| 5,149,071 | 9/1992 | Oliveira | 269/43 |
| 5,161,787 | 11/1992 | Hobday | 269/6 |
| 5,401,354 | 3/1995 | Colucci | 156/580 |

*Primary Examiner*—David A. Simmons
*Assistant Examiner*—J. Sells
*Attorney, Agent, or Firm*—Fulwider Patton Lee & Utecht

[57] ABSTRACT

A multi-purpose clamping apparatus to join the confronting edges of two boards together during a gluing process having a pair of base plates, a central hub about which the base plates may be rotated, a rail projecting laterally from the hub on which one of the base plates is connected and a press mounted on one of the base plates and engaging the rail for drawing the base plates together. Respective clamps overlie the upper surface of the base plates.

16 Claims, 5 Drawing Sheets

FIG. 12
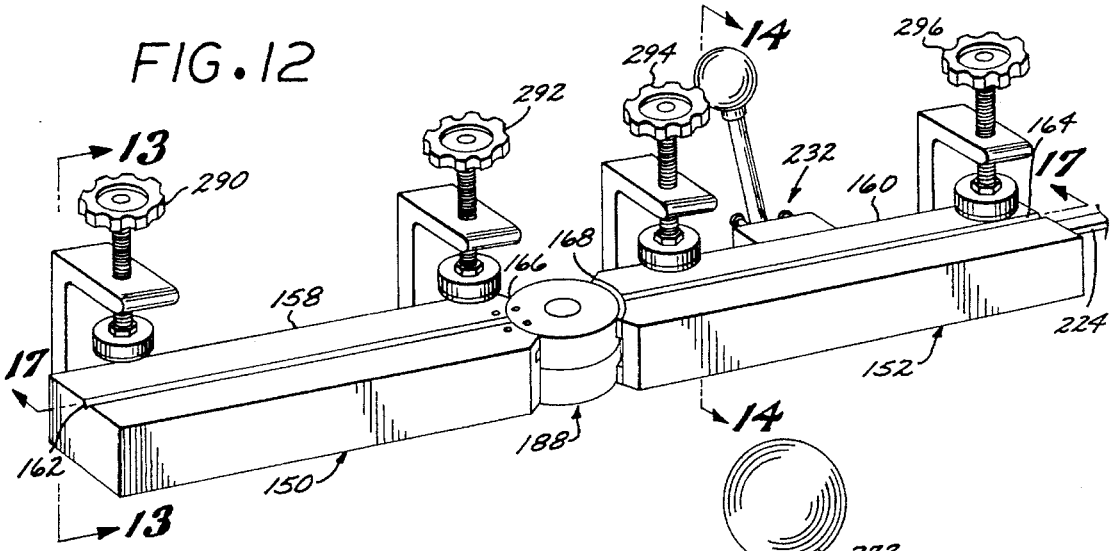
FIG. 13
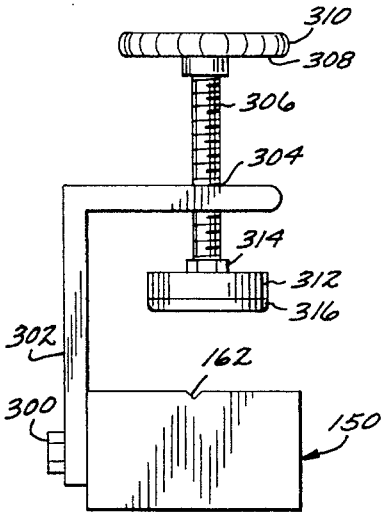
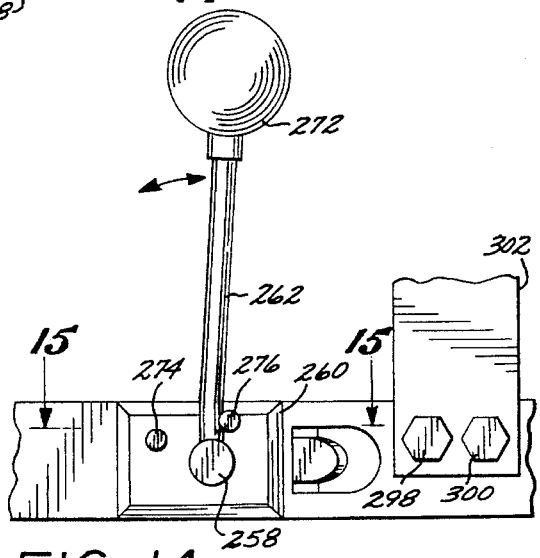
FIG. 14
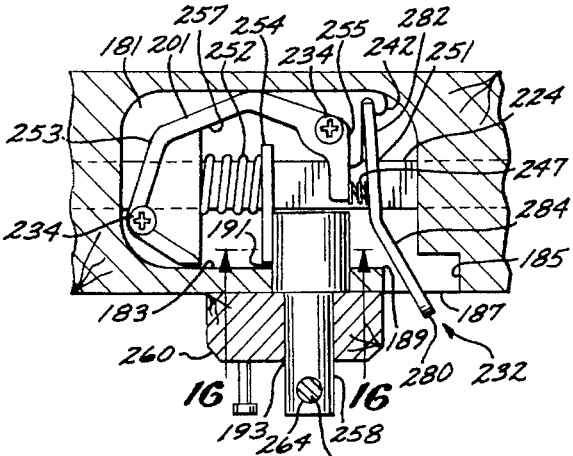
FIG. 15
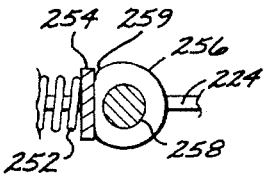
FIG. 16

MULTI-PURPOSE CLAMPING APPARATUS

This application is a continuation-in-part of application Ser. No. 08/123,874, filed Sep. 20, 1993, now U.S. Pat. No. 5,401,354.

BACKGROUND OF THE INVENTION

1. Field of the Invention

This invention relates to a multi-purpose clamping apparatus for pressing the confronting edges or ends of two boards or other components during a gluing process.

2. Description of the Prior Art

In the practice of woodwork crafting the occasion often arises where boards or other components of wood or composites or other man-made materials are to be joined together along proximate edges or ends to provide a composite frame, border or panel to be integrated into a piece of furniture or molding. For narrow slats and the like, conventional clamps and vises, having a bite sufficient to span the width of the boards or items being joined, are satisfactory to engage the opposite sides of such boards and press them firmly together at the edges to be joined. However, difficulty is encountered when the boards to be joined are collectively wider than the bite of a conventional vise. A challenge is also presented when the boards are to be joined endwise thus requiring gripping of the boards for application of compressive forces in the longitudinal direction. The challenges encountered are compounded when the boards to be joined are to project at various angles, such as 90° to one another. In practice, it is desirable to orient the components in edgewise contacting relation ("dry joint") to secure the relative positioning so as to visually check the fit and then, if satisfactory, separate such components to space the components apart for access to the mating edges for application of glue while monitoring the relative component orientation for repeating the mating fit with the glued edges. Numerous differed devices have been proposed in effort to solve the problems encountered in joining wide boards together laterally, lay boards together endwise, and other boards together at various uncommon angles.

One such mechanical device for clamping together of the confronting edges of boards during a gluing process incorporates a vise-like bar-clamp having two jaws at opposite ends of a bar that draw together boards placed in-between as the jaws are drawn together in a screw-like action. These vise-like clamping devices must more or less vary in size in direct relation to the composite span of the boards to be joined. Where large boards, such as plywood or particle board, or odd shapes, such as round stock, are used, the task of aligning the boards and clamping the boards in-between bar clamps can be burdensome indeed.

Another clamping device proposed for joining wide boards edgewise includes a screw to draw two barrel nuts together that are inserted within pilot holes drilled into the boards. The joint is secured tightly by adjusting the screw between the two barrel nuts. While such a clamping device is not size dependent in relation to the scale of the boards, the device does require that pilot holes be drilled into the surface of the boards in order to secure barrel nuts. Drilling of these holes requires care and skill to avoid unwanted damage such as accidental drilling through to the opposite face and in any event leaves the unsightly holes visible in the finished product themselves. Moreover such devices are not adaptable for practical use in joining oddly configured components such as round stock or cylindrically shaped molding.

Other efforts to solve the problem led to the development of a clamp having an elongated rail carrying a push plate driven therealong by a drive screw to push one board against the edge of another held in place on such rail by a grip jaw, U.S. Pat. No. 3,603,580. One such clamp device is marketed by Universal Clamp Corp. of Van Nuys, Calif. Such devices, while satisfactory for some applications, suffer the shortcoming that there is no provision for making a dry joint contact of the board edges to establish relative orientation of the boards and then holding them in such fixed relative orientation while they are separated for application of glue and subsequent compressed contact with one another.

Finally, for smaller pieces, an adjustable corner and splicing clamp has been employed consisting of a pair of vise-like clamps adjustably mounted on a protractor for clamping miter or butt joints at any selected angle as required. In a device of this type, the two vises are rotated into position along the protractor and the boards may be secured at their widths by the vises. While such devices work well for picture frames and the splicing of molding and trim, the vise clamps prove inadequate for securing larger boards together.

Wood workers have from time to time been forced to rely on trial and error techniques which often include extensive shaving or sanding of the confronting edges prior to the application of glue to the confronting edges.

None of the clamping devices or techniques of the prior art offer a practical device allowing for alignment of the boards to be glued to establish the desired orientation and alignment and then for separation to expose the confronting edges for application of glue or other bonding material while monitoring such established orientation and alignment for pressing of such boards back together without requiring that the boards be realigned.

In my parent patent application Ser. No. 08,123,874, filed Sep. 20, 1993, and now U.S. Pat. No. 5,401,354, I disclose a clamping apparatus characterized by a pair of base plates formed with upwardly facing support surfaces for securing a pair of respective components thereon during the process of gluing their confronting edges together wherein each base plate includes respective clamps to maintain the respective boards fixed against the base plates. Included between the two base plates is a rail that couples the first and second base plates together and permits movement of the second base plate therealong permitting the two base plates, with the components affixed therein, to be separated for access of glue to the edges, and then to be pressed together without disturbing alignment of such components. A trigger shaped press, mounted on the second base plate, when actuated, incrementally draws the second base plate along the rail towards the first base plate firmly pressing the confronting edges of the two boards clamped thereon together. Such a device, while acceptable for its intended purposes and having substantial commercial utility, has a multiplicity of odd shaped parts thus making the device costly to manufacture. In addition, the latching, indexing and biasing functions are carried out by complex sub-assemblies lessening the reliability and durability of the device.

Consequently, there exists a need for a clamping apparatus having sub-assemblies which are simpler and easier to build so as to comprise a device which is more reliable and durable, while being inexpensive to manufacture.

SUMMARY OF THE INVENTION

The clamping apparatus of the present invention is characterized by a pair of base plates formed with upwardly facing support surfaces for securing a pair of respective components thereon during the process of gluing their confronting edges together wherein each base plate includes respective clamps to maintain the respective boards fixed against the base plates. Included between the two base plates is a rail that couples the first and second base plates together and permits movement of the second base plate therealong permitting the two base plates, with the components affixed therein, to be separated apart for access of glue to the edges, and then to be pressed together without disturbing alignment of such components. A trigger shaped press, mounted on the second base plate, when actuated, incrementally draws the second base plate along the rail towards the first base plate firmly pressing the confronting edges of the two boards clamped thereon together. The present invention provides the opportunity to refine the confronting edges of the components and apply the glue after the boards have been securely aligned in the clamp. Once glue has been applied to the components, the press is actuated to draw the confronting edges together.

It is a further object of this invention to permit the clamping apparatus to pivot the base plates about a pivot axis to allow for the angular displacement of the base plates to be adjusted according the joint angle formed by the connection of the two components.

Other objects and features of the invention will become apparent from consideration of the following description taken into connection with the accompanying drawing.

BRIEF DESCRIPTION OF THE DRAWINGS

FIG. 12 is a perspective view of a second embodiment of the clamping apparatus of the present invention;

FIG. 13 is a transverse partial view, in enlarged scale, taken along the line 13—13 of FIG. 12;

FIG. 14 is a partial back view, in enlarged scale, of the clamping apparatus shown in FIG. 12;

FIG. 15 is a transverse sectional view, in enlarged scale, taken along line 15—15 of FIG. 14;

FIG. 16 is a partial longitudinal sectional view, in enlarged scale, taken along line 16—16 of FIG. 15;

DESCRIPTION OF THE PREFERRED EMBODIMENT

Figure 1:
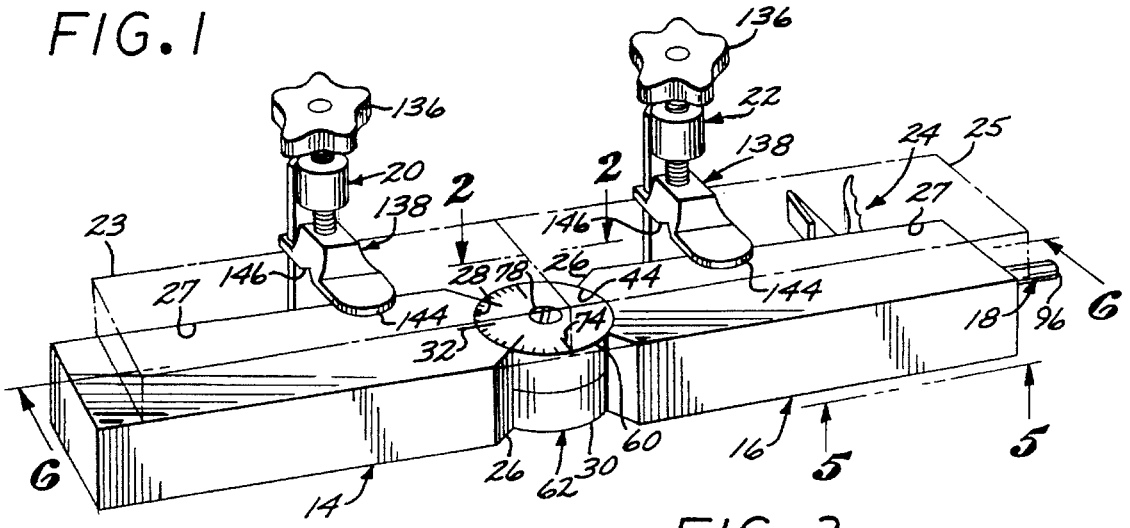
FIG. 1 is a perspective view of a clamping apparatus embodying the present invention.
Figure 2:
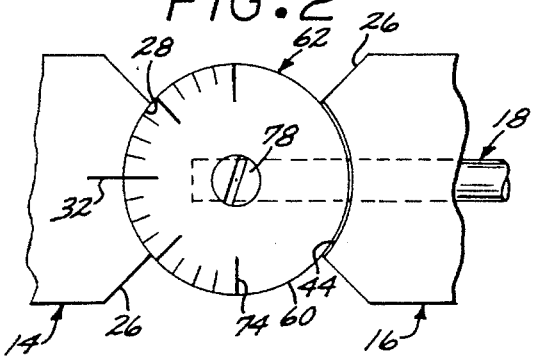
FIG. 2 is a partial top plan view, in enlarged scale, taken along line 2—2 of FIG. 1.

Referring to FIG. 1, as set forth in my application Ser. No. 08/123,874, filed Sep. 20, 1993, now U.S. Pat. No. 5,401, 354, the clamping apparatus of the present invention includes, generally, a pair of base plates 14 and 16 which may be of a generally rectangular brick-like shape and pivotally connected together along an elongated rail 18 on which plate 16 slides. The base plates support respective upstanding C-clamps, generally designated 20 and 22, for selectively clamping components such as boards 23 to the respective top surfaces of such base plates 14 and 16. A friction press, generally designated 24, mounted in the base plate 16 controls movement of such plate relative to the base plate 14 and is operative to provide a mechanical advantage in selectively driving base plate 16 and, consequently, a component clamped thereon, toward the base plate 14. Thus, the plates 14 and 16 may be adjusted to a selected position such as that shown on FIG. 1 and components such as flat boards 23 and 25 positioned thereon in contacting edgewise relations, the clamps 20 and 22 closed to secure such components in relative mating position on such base plates. The brake 102 of the press 24 may then be released to free the base plate 16 to slide on the rail 18 away from base plate 14 to expose the confronting edges of such components for application of glue. The base plate 16 may then be slid freely back on the rail 18 to shift the component 25 back into mating contact as previously established with component 23. The press 24 may then be activated to press the plate 16 toward the plate 14 to thoroughly press the edges of the components 23 and 25 firmly together while maintaining the previously established relationship.

The main support for the components 23 and 25 is provided by the base plates 14 and 16 that consist of rectangular wooden blocks having an overall brick-like shape tapered at the corners of their proximal ends to form respective chamfers 26. The upper surface 27 of each of the blocks is textured or coated with a grit matting to prevent sliding of the components when placed on the blocks. The wooden blocks provide a firm rigid support surface for the components 23 and 25 that is lightweight and easy to manufacture. The use of wooden base plates also reduces the risk of damage to components 23 and 25 due to scratching during mounting of the components as would be encountered with metal base plates. Each of the base plates 14 and 16 include tapered corners 26 at their respective confronting proximal ends thereby reducing the surface area of the proximal end.

With reference to FIGS. 1–4, 6 and 8, the first base plate 14 is formed at one extremity with a semi-cylindrical concavity 28 carved out of the upper half and a cylindrical tongue 30 projecting from the lower half and configured with the same radial center point as that of the concavity 28. On the upper surface of the first base plate 14, a central pointer mark 32 extends longitudinally to the edge of the concavity end to visibly identify the center point of the concavity 28. At the radial center point of the tongue, a bore hole 34 extends through the center of the tongue with a counter bore 36 on the underside of the tongue. A threaded bore hole 38 (FIG. 6) is drilled through the tongue at a point half way between the counter bore 36 and the proximal end 28 of the first base plate 14. The bore hole 38 threadably receives a set screw 40 terminating at its upper extremity in an index tip 42 projecting about the top surface of such tongue.

It will be appreciated that the function of the index screw is only to establish a positive angular relationship between the base plates 14 and 16 and may take many different forms. The threaded bore 38 could be in the form of a blind bore drilled at the same location in the upper surface of the tongue and housing an open ended barrel having a retainer rim about the open end to retain a spring loaded index ball to be pressed into selective engagement with indents.

Figure 5:
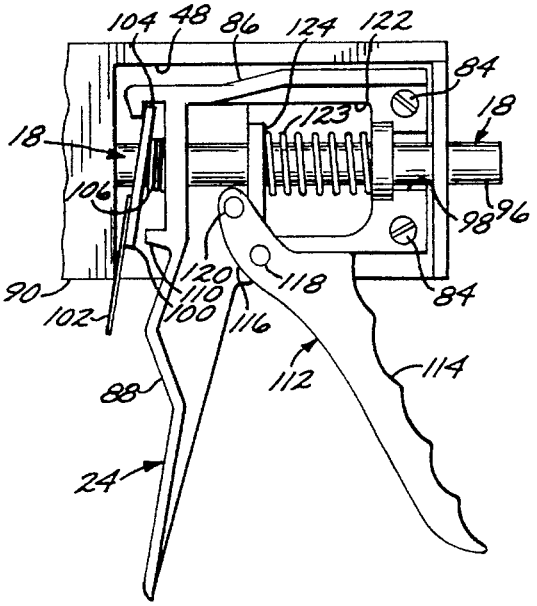
FIG. 5 is a transverse sectional view in enlarged scale, taken along line 5—5 of FIG. 1.
Figure 6:
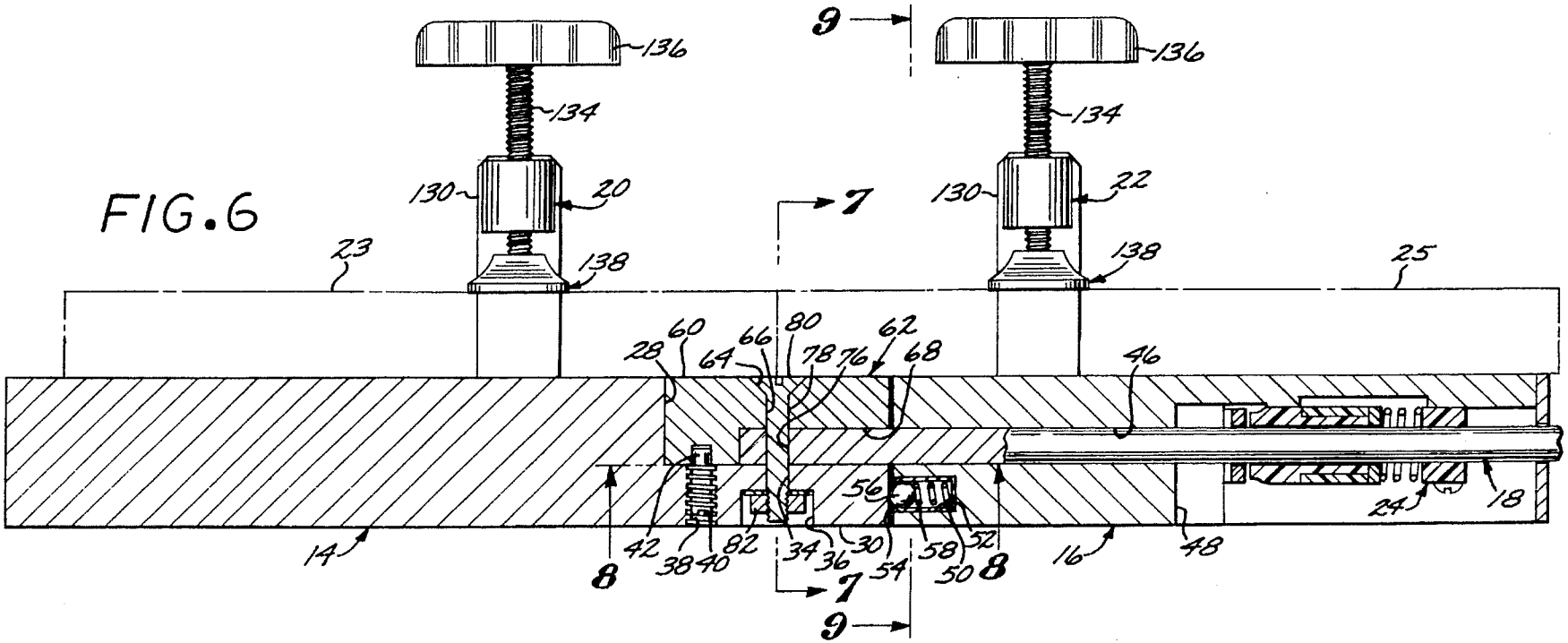
FIG. 6 is a longitudinal front sectional view, in enlarged scale, taken along line 6—6 of FIG. 1.

With continued reference to FIGS. 1–4, 6 and 8, the proximal end of a second base plate 16 is shaped with a cylindrical concavity 44 that complements the curvature of the end of the cylindrical tongue 30 to be abutted there-against. Formed centrally along the longitudinal axis of base plate 16 is an open ended slot 46 (FIG. 6). The slot 46 may be of either rectangular or cylindrical in cross section. The distal extremity of the plate 16 is hollowed out to form a downwardly opening clamp chamber 48 (FIGS. 5 and 6).

Referring to FIG. 6, a blind bore 50 is drilled longitudinally into the proximal end of the plate 16 centrally in the concavity 44 aligned under the slot 46 to receive an open ended barrel 52 having a retainer rim 54 about the open end. A ball bearing 56 is housed in the barrel to be biased against the rim 54 by means of a bias spring 58.

A cylindrical disk 60 (FIGS. 1 and 6) having the same thickness and diameter as the tongue 30 of the first base plate 14 overlies the tongue and cooperates therewith to form a central hub 62. From a counter sunk cavity 64 on the upper side of the disk 60, a bore hole 66 extends through the cylindrical center of the disk and aligns with the bore hole 34 in the tongue 30. On the underside of the disk 60, a diametrical, open ended mortise 68 is carved to align with the end of the slot 46 (FIG. 6).

Figure 8:
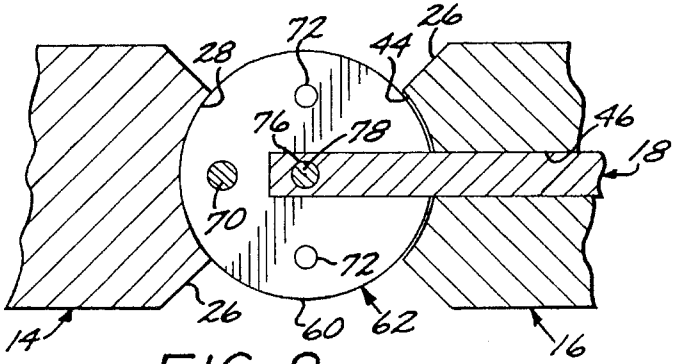
FIG. 8 is a partial longitudinal sectional view, taken along line 8—8 in FIG. 6.
Figure 7:
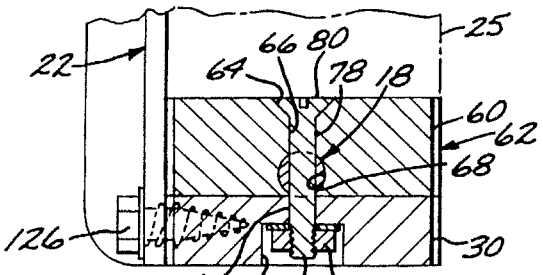
FIG. 7 is a transverse sectional view, in enlarged scale, taken along line 7—7 of FIG. 6.
Figure 9:
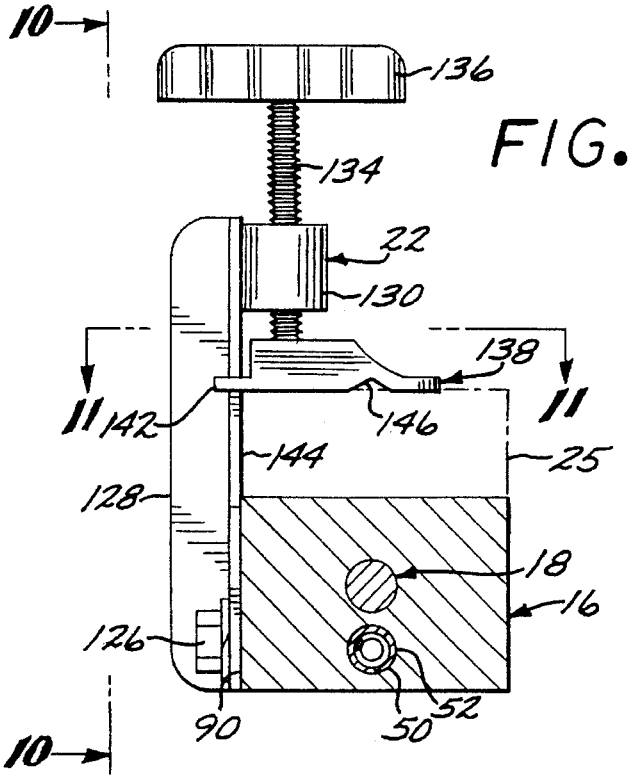
FIG. 9 is a transverse sectional view taken along line 9—9 of FIG. 6.
Figure 10:
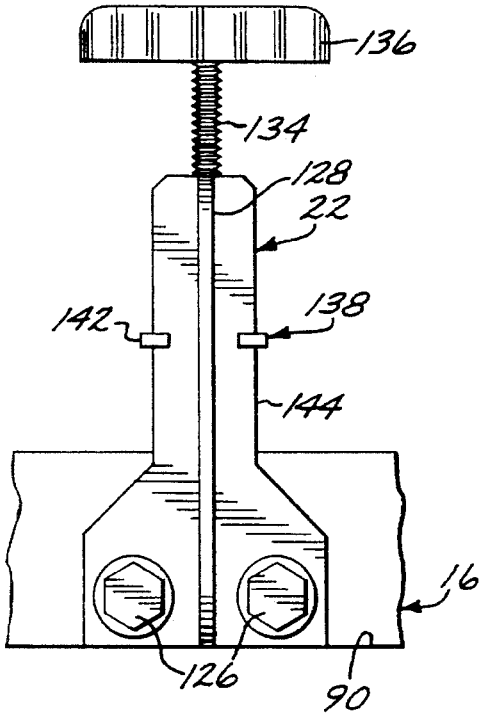
FIG. 10 is a partial back view taken along line 10—10 of FIG. 9.
Figure 11:
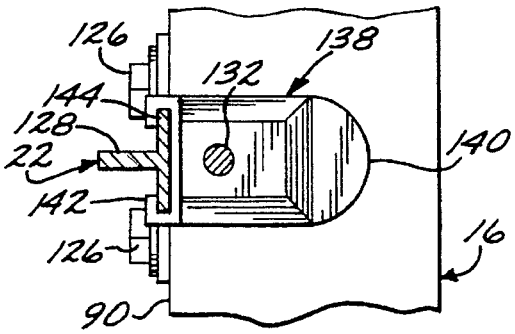
FIG. 11 is a longitudinal top view taken along line 11—11 of FIG. 9.

Referring to FIG. 8, a plurality of index bores 70 and 72 are drilled into the underside of the disk and correspond to predetermined angular locations 90°, 180° and 270° with respect to the radius formed by the mortise 68. The index bores 70 and 72 are all drilled on the same radius as the threaded bore 38 in the tongue 30 of base plate 14 so the set screw will, when clocked to the appropriate position, align therewith. Referring to FIGS. 1– 4, protractor indicia 74 is printed about the periphery of the top side of the disk 60 to register with the pointer 32.

The tension rail 18 telescopes from the tensioning chamber 48, through the slot 46 (FIG. 6) and into the mortise 68 and is formed with a bore 76 aligned with the tongue bore 34 and disk bore 66. A bolt 78 extends through the bores 66, 76 and 34 such that the head 80 of the bolt nests in the counter sunk cavity 64 in the disk 60 and a nut 82 is threadably secured to the bolt, housed in the counter sunk cavity 36 on the underside of the tongue. Although firmly secured, the rod 18 and disk 60 are free to pivot about the central bore hole with respect to the base plate tongue 30.

A pistol-handled friction press 24 (FIG. 5) is housed in the chamber 48 of the base plate 16 and secured by a pair of wood screws 84. While friction press 24 may take many different forms, the one selected for illustration is similar in design to the trigger presses found on commercially available caulking guns. A rectangular frame 86 is housed within the chamber 48 formed at the backside proximal corner with a pistol handle 88 that extends laterally out of the backside opening 90 in the cavity. The rectangular frame 86 includes a thick rim 92 that extends from the free end of the handle 88 along the proximal end of the frame to the front side distal corner 94 of the frame opposite from where the handle begins. When viewed laterally, the handle and rim combine to exhibit a T-shape appearance that structurally enhances the handle to withstand the torque forces applied to it by the craftsman's grasp. The rim side of the handle is contoured to ease in gripping the handle. The rod 18 is inserted through the proximal end of the second base plate with the free end 96 of the rod 18 extending out the distal end. The rectangular frame 86 receives the rod 18 through a longitudinal slot 98 formed in the frame where at the receiving end of the frame a spring biased friction latch 100 and release 102 is secured to the frame by an overhanging lip 104 or J-hook projecting longitudinally away from the front side corner of the frame 86. The friction latch 100 includes a vertically extended oval shaped aperture (not shown) with a lower edge that is biased by a spring 106 to frictionally grip the underside 108 of the rod to prevent withdrawal of the second base plate toward the free end of the rod. A latch release 102 is connected to the friction latch 100 with a free end that extends out of the second base plate 16 in spaced apart relation to the handle 88 such that, when sufficient pressure to counter the spring bias is applied to the release 102, the lower end of the friction latch 100 is drawn towards the handle thus freeing the rod from the lower edge of the aperture. A release stop 110 extends horizontally out of the lower corner of the frame to stop the friction latch at the point where the rod is freed therefrom.

A trigger 112 (FIG. 5) pivotally carried from the frame near the base of the handle includes a trigger grip 114 molded with finger contours that diverges out from the handle base such that the free end of the trigger 112 is in spaced apart relation with the free end of the handle 88. Side supports 116 on the trigger slide over opposite sides of the frame 86 and a cross-member 118 pivotally connects the trigger to the frame. A second cross member 120 bolts to the free ends of the trigger side supports 116. A spring biased friction press 124, located within an aperture 122 in the frame 86, is biased against the second cross member 120 by a spring 123 and receives the rod through a vertically extended oval aperture in the friction press.

Referring to FIGS. 1 and 9–11, respective upstanding C-clamps 20 and 22 are mounted on the base plates by a pair of bolts 126 securing the respective clamps 20 and 22 to the base plates 14 and 16. With reference to the second base plate clamp 22, an upstanding T-shaped neck 128 rises above the upper surface of the base plate 16 onto which a boss 130 is mounted in overlying relation to the upper surface 27 of the base plate. The boss 130 includes a threaded bore 132 (FIG. 11) supporting a screw 134 therein. A handle 136 (FIG. 9) is attached to the upper end of the screw and a foot 138 couples to the lower end of the screw. The foot is generally in the shape of a horizontal tombstone (FIG. 11) having a rounded front end 140 to receive wood stock 25 without damaging the wood stock against sharp corners. Carried from the rear end of the foot a pair of rearwardly projecting inturned cleats 142 slidingly capture the outer edges 144 of the upstanding neck. Formed in the underside of the foot, a V-groove 146 extends width-wise across the foot to accommodate the periphery of round stock, alternatively the grooves could be formed in the top surface of the underlying base plates.

In operation, a wood worker must first prepare the clamping apparatus for the task at hand. If frames or oddly shaped components are to be joined, then the base plates 14 and 16 may be pivoted to the corresponding angle formed by the joined components 23 and 25. The base plates may be pivotally rotated to any angle within 90 degrees on either side of each other. The tapered clearance corners 26 on the proximate ends of the base plates 14 and 16 allow this increased range of rotation about the hub 62. The index mark 32 and protractor indicia 74 cooperate to allow the wood worker to exactly align the base plates 14 and 16 to the necessary joint angle. Once the angle between the base plates has been achieved, the angle may be secured by rotating the set screw 40 until its tip 42 contacts the disk 60 above the tongue 30. Index bores 70 and 72 in the disk 60, located at the most often used pivot angles, receive the tip 42 of the set screw 40 thereby locking the angular displacement of the base plates securely in the selected angle. Once the desired angle has been selected, the release 102 on the second base plate 16 is drawn towards the handle 88 of the friction press 24 to allow the rail 18 to telescope freely through the second base plate 16 thus allowing the second base plate 16 to be adjusted in a slight spaced apart relationship to the hub 62. Finally, the respective clamp handles 136 are rotated until each foot 138 is raised sufficiently away from the upper surface 27 of the base plates to receive the components 23 and 25 in between.

Once the clamping device has been properly adjusted, the respective components 23 and 25 to be joined are placed on the textured upper surface 27 of the base plates. The confronting edges are positioned in contact with one another and the C-clamps 20 and 22 are closed to secure the respective components against the upper surface 27 of the base plates 14 and 16. It will be appreciated that the spacer ball 54 will serve to maintain the base plate 16 spaced distally from the tongue 30 and hub disk 32 by about 1/16 of an inch even though the edges of the boards 23 are in intimate contact. The press may be released so the plate 16 can be freely slid thereon away from the plate 14 to space the adjacent edges of the boards 23 and 25 apart so ready access can be had thereto. Glue may then be applied to the spaced apart edges of the board and the friction press 24 actuated to release the grip on the rail 18 to free the plate 18 so it can be slid toward the hub. The press may then be operated to incrementally draw the base 16 toward the plate 14 thus retracting the spacer ball 54 into the barrel 50 (FIG. 6) to provide for the components 23 and 25 to be drawn firmly together. By incrementally drawing the base plates together, the craftsman is able to selectively chose the necessary amount of pressure to be applied to the confronting edges of the respective components thereby insuring that all of the glue is not squeezed out of the joint by the clamping device. When the components have dried, the clamps 20 and 22 are opened and the joined components removed.

Figure 3:
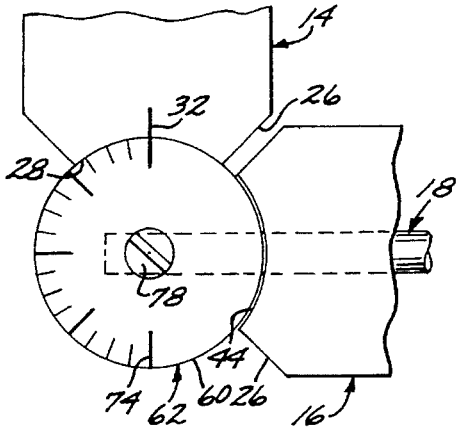
FIG. 3 is a top plan view similar to FIG. 2 showing the clamping apparatus rotated about its center axis.
Figure 4:
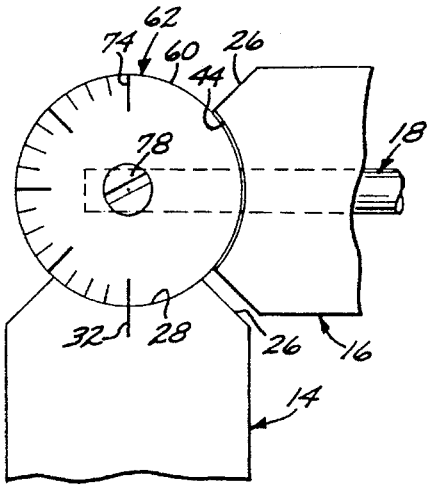
FIG. 4 is a top plan view similar to FIG. 2 showing the clamping apparatus rotated about its center axis opposite to FIG. 3.

It will be appreciated that with the articulation capability about the hub, the plate 16 may be selectively rotated about such hub to the position shown in FIG. 3 so that the respective clamps are positioned facing outwardly at 90° from one another. It will be appreciated by those skilled in the art that, in this orientation, the clamp apparatus may be conveniently fitted into the inside corner of, for instance, a frame with 90° corners to thus clamp the adjacent frame components by such clamp so they may be drawn together by the press. Similarly, in the orientation shown in FIG. 4, the clamps 20 and 22 will be facing inwardly so they may be clamped over the outside edges of 90° frame components so the press may be utilized to draw such components together from the outside.

The embodiment of the clamping apparatus shown in FIGS. 12–19 is similar to that shown in FIGS. 1–11 and includes, generally, a pair of base plates 150 and 152 of generally rectangular brick-like shape and pivotally connected together on their proximate ends to a hub 188. The plate 152 is constructed for slidable mounting on an elongated metal rail 224. The base plates support several upstanding C-clamps, generally designated 290, 292, 294 and 296, for selectively clamping components to the respective top surfaces of such base plates 150 and 152. A friction press, generally designated 232, mounted in the base plate 152 controls movement of such plate relative to the base plate 150 and is operative to provide a mechanical advantage in selectively driving base plate 152 and, consequently, a component clamped thereon, toward the base plate 150. Thus, the plates 150 and 152 may be adjusted to a selected angular position relative to one another, such as that shown in FIG. 12, and components positioned thereon in contacting edgewise relation and the clamps 290, 292, 294 and 296 closed to secure such components in relative mating position on such base plates. The brake lever 282 of the press 232 may then be released to free the base plate 152 to slide on the rail 224 away from base plate 150 to expose the confronting edges of such components for application of glue. The base plate 152 may then be slid freely back on the rail 224 to shift the component back into mating contact as previously established with the other component. The press 232 may then be activated to press the plate 152 toward the plate 150 to thoroughly press the edges of the two components firmly together while maintaining the previously established relationship.

Figure 17:
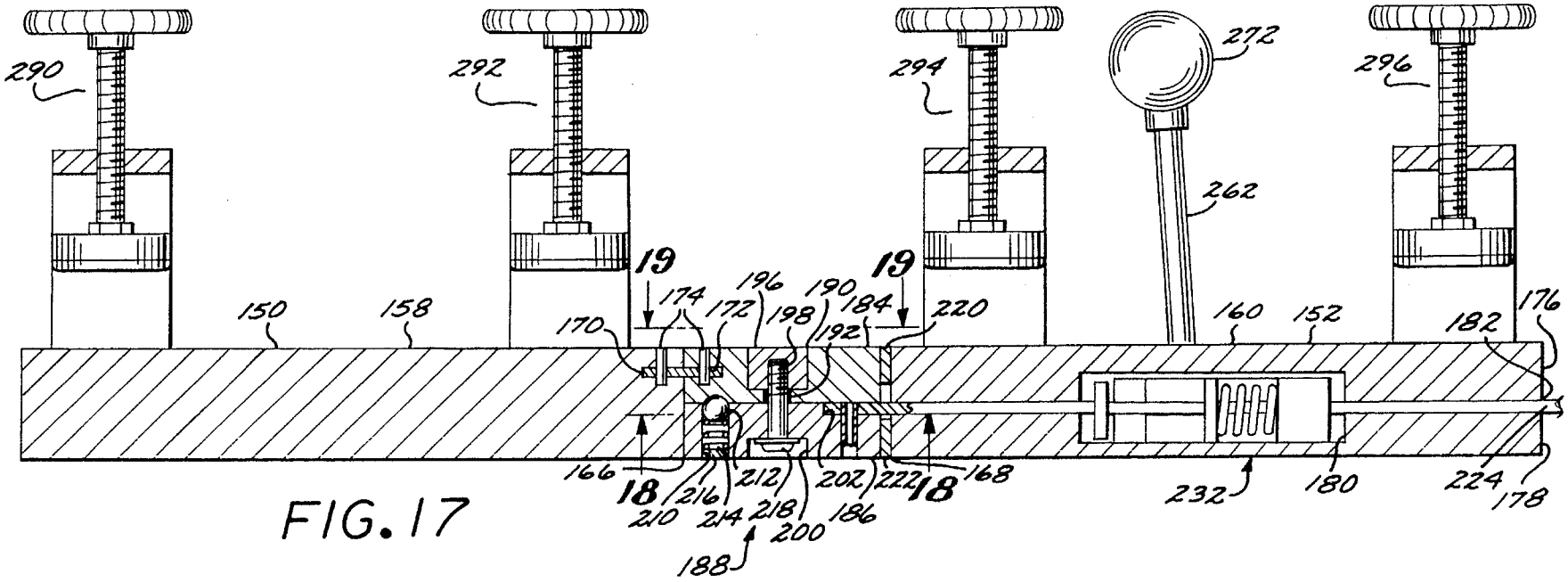
FIG. 17 is a longitudinal front sectional view, in enlarged scale, taken along line 17—17 of FIG. 12.
Figure 19:
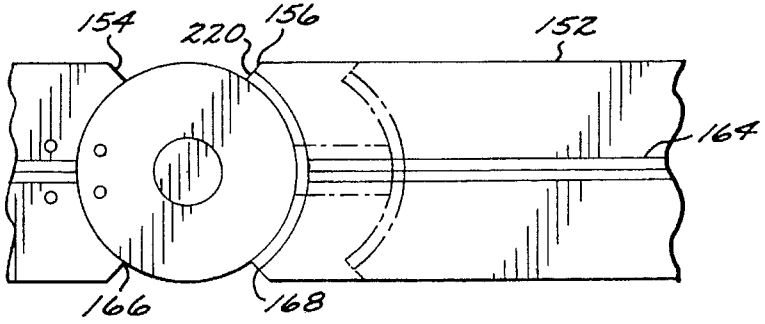
FIG. 19 is a longitudinal top view taken along line 19—19 in FIG. 18, illustrating movement of base plate along rail and mating of spacer to hub.

Referring to FIGS. 12 and 17, base plates 150 and 152 consist of rectangular wooden blocks having an overall brick-like shape tapered at the corners of their proximal ends to form respective chamfers 154 and 156. The respective upper surfaces 158 and 160 of each block is textured or coated with a grit matting to prevent sliding of the components when placed on the block. Respective, longitudinally extending V-grooves 162 and 164 open upwardly from the surfaces of the respective blocks extending longitudinally end to end. The base plates have semi-cylindrical concavities 166 and 168 carved from the respective proximal ends and extending throughout the depth of the blocks.

Referring to FIG. 17, the base plate 150 is formed at its proximate end with an open ended anchor slot 170. An anchor pin 172 is formed to fit within the slot and extends outwardly therefrom to be received in a confronting bore in the hub 188 to be secured by transverse fasteners 174.

The other base plate 152 is formed by two overlying blocks 176 and 178 stacked in parallel alignment. The blocks 176 and 178 are formed centrally with respective confronting cavities which cooperate to form a central interior press chamber, generally designated 180, within base plate 152. It will be appreciated that by constructing the chamber 180 in this manner, the operating components of a friction press, generally designated 232, installed within the chamber will be protected from the surrounding environment.

The chamber is formed to define, in plan view, a generally rectangular, rounded corner, main cavity 181 (FIG. 15) formed with a return defining a back wall 183 which terminates at its proximal end in an edge 189 spaced from a confronting clearance notch 185 to form a rearwardly facing release opening 187. The back wall is formed with a transversely extending through, circular bore 191 covered on its back side by a bearing block 260 having a through bearing bore 193 formed therein. Referring to FIG. 14, a pair of stop pegs 274 and 276 are disposed in angular relation to such bearing bore 193.

The top block 176 (FIG. 17) is formed on its bottom side with a downwardly opening longitudinal slot 182 extending from end to end for receipt of an elongated rail 224 extending the length thereof and projecting from the distal end.

Referring to FIG. 15, the press mechanism may be of the general type incorporated in conventional clamping mechanisms, such as that sold under the trade designation QUICK GRIP, Mini Bar Clamp by American Tools Company, Inc. The press includes a U-shaped frame, generally designated 201, formed with rounded corners for complementally fitting in the chamber 180 and including, as viewed in FIG. 15, a left hand transverse leg 253 and right hand transverse leg 255 which span a central throat 257. The frame is secured in place by means of respective mounting screws 234.

The respective legs 253 and 255 are formed with longitudinally extending through slots for slidable receipt of the longitudinally extending rail 224. Mounted within the throat 257 and in overlying position on the interior surface of the leg 255 is a transversely extending floating pusher plate 254. Such pusher plate 254 is formed with a transverse slot which loosely receives the rail 224 in a slip fit relationship for telescoping therethrough of such rail when the plate is in its position shown in FIG. 15 projecting perpendicularly to such rail but configured to, when the bottom end of such plate is pushed to the left from the position shown in FIG. 15, grip such rail within the transverse aperture. The pusher plate 255 is biased to the right as viewed in FIG. 15 by means of a coil compression spring 252 telescoped over such rail 224 and sandwiched between the leg 253 and such pusher plate itself.

With continued referenced to FIG. 15, the right hand leg 255 is formed on the upper side thereof with a clip which projects longitudinally to the right and turns downwardly to form a retainer lip 242 cooperating with the leg itself to define a retainer notch within which one end of a pivotal brake lever 282 is pivotally trapped. The brake lever 282 projects generally laterally of the rail 224 and is formed with a rectangular aperture 251 which is close fit over such rail for sliding receipt thereof. The brake 282 is formed with an angled handle 284 which conveniently projects through the release opening 187 to form a finger grasp for selective release of the press.

Journaled through the bearing bore 193 (FIG. 15) is a bearing shaft 258 configured on its interior extremities with a cylindrical cam 256 formed with a tangential cam surface 259 disposed in confronting relationship with the tab defined by the projecting end of the pusher plate 254. The projecting end of the axle shaft 258 is formed with a transverse bore 264 press fit receipt of the bottom and of a lever rod 262. Surmounted on such lever rod 262 is a spherical knob 272.

With continued reference to FIG. 17, the hub 188 includes a pair of like thickness cylindrical upper and lower disks 184 and 186, respectively, disposed in stacked relation to be interposed between, and confronted along their peripheries, by the concavities 166 and 168. The disks are concentric with and share the same radial center point as the base plate concavities 166 and 168. The upper disk 184 is formed centrally with an upwardly opening blind countersunk bore 190 and a reduced-in-diameter through pivot bore 192. The lower disk 186 has a countersunk cavity 200 on the lower side of the disk 186 extending through the cylindrical center of the disk and aligning with the bore hole 192 in the upper disk 184. Formed in the top surface of the lower disk 186 is a diametrical, upwardly opening blind notch 202 aligned longitudinally with and opening on the circumference of such disk in confronting relation with the rail slot 182.

Figure 18:
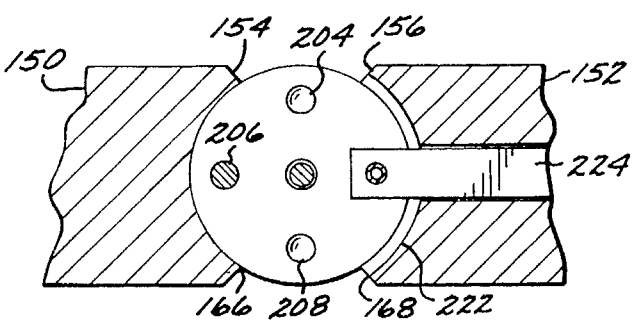
FIG. 18 is a partial longitudinal sectional view, taken along line 18—18 in FIG. 17.

Referring to FIGS. 17 and 18, a plurality of semispherical index pockets 204, 206 and 208 are formed in the underside of the upper disk 184 at angular locations relative to the center of the hub and correspond to predetermined angular locations 90°, 180° and 270° with respect to the longitudinal axis of base plate 152. The index pockets 204, 206 and 208 lie on the same radius with respect to the upper disk 184 centerpoint. A through bore 210 is drilled downwardly into the lower disk 186. A ball bearing 212 is housed in the through bore 210 to be biased upwardly against index pockets 204, 206 or 208 by means of a bias spring 214 once the disks are assembled together. Closing the through bore from underneath the lower disk, a set screw 216 forms a support structure for the bias spring and can adjust the compression on the spring 214. A threaded bolt 218 is inserted into countersunk bore 200 of lower disk 186 extending through the bore 192 of upper disk 184 and formed with threads 198 to be screwed into a nut 196 nested in the counter bore 190.

Conveniently, compressible spacer pads 220 and 222 are interposed between the periphery of the hub 188 and the concavity base plate 152 to be located equidistant above and below the central horizontal plane to bias the base plate 152 a selected distance from the hub. The pads 220 and 222 are respectively formed from a compressible and fully recoverable rubber material and are approximately 1/16" thick. Bonded to the upper and lower surfaces of concavity 168, the pads have curved upper surfaces concentric with the concavity 168 upper surface.

Referring to FIGS. 12, 13, 14 and 17, respective upstanding C-clamps 290, 292, 294 and 296 are mounted on the base plates by respective pairs of bolts 298 and 300 which secure the respective C-clamps to the base plates. With particular reference to FIG. 13, an L-bracket 302 is bolted upright to a base plate with bolts 298 and 300 so as to form a "C" shaped support. A threaded hole 304 is drilled through the upper ledge of the support through which a screw 306 is inserted. The diameter and pitch of the screw matches the threaded hole. The upper end of the screw terminates in a rotary dial 308 having grippable edges 310 for easy turning. The lower end of the screw 306, enclosed by the C-shaped support, terminates into the rear end of a circular foot 312. The foot 312 is secured from rotating about the screw 306 by a nut 314. A hard, non-scratching plastic wafer 316 is mounted to the underside of the foot 312 and secures boards or other objects to the respective base plate during operation of the apparatus. It will be appreciated that the C-clamps are very simple in construction and operation and easily adjustable. As will be apparent to those skilled in the art, the clamps may take many different forms and still be operative to secure the respective portions of the work pieces relative to the respective base plates. In practice the clamp shown by way of example could be replaced by any well known gripping device or even holding blocks against which the distal ends of the respective work piece would abut, all without affecting the scope of the present invention.

Operation of the alternative embodiment is substantially similar to the previously disclosed embodiment. The base plates 150 and 152 may be pivoted relative to the hub to predetermined angles 90°, 180° and 270° as the task at hand requires.

Once the desired angular relation between the base plate pieces has been established by setting the angular relation between the base plates 150 and 152, the workman may press the projecting tip 280 of the brake lever 282 to the left as viewed in FIG. 15 against the bias of the compression spring 247 thus pivoting such lever 282 clockwise to a position to contact the edge 189 thus orienting such lever perpendicular to the rail 224 to thus bring the aperture through such rail into alignment with the path of such rail and disengaging the walls of such aperture from contact with the rail for free movement of the brake lever and consequently the base plate 152 relative to the rail so that such base plate may be slid axially on the rail for convenient positioning of the work pieces with the approximate end thereof in abutting contact with one another for achieving the desired positioning. The C-clamps may then be tightened to clamp the work pieces in a fixed relation on the respective base plates 150 and 152.

Then, if desired, the brake lever 282 may again be rotated clockwise to its release position so that the base plate 152 may be slid to the left as viewed in FIG. 15 or to the right as viewed in FIG. 12, away from the hub 188 to thereby move the proximate ends of the work pieces into a spaced apart relation so that access can be had thereto for applying a glue, bonding agent or other material. After the glue has been applied, the brake 282 may again be pivoted clockwise as viewed in FIG. 15 to its release position to allow the base plate 152 to freely slide to the right as viewed in FIG. 15, or to the left as viewed in FIG. 12, to bring the abutting edges thereof, with the glue applied, into loose contact with one another. Then, the workman may grasp the knob 272 and rotate the lever arm 262 thereby rotating the axial 258 in the bearing bore 193 to thus rotate the cam flat out of its plane corresponding with the transverse plane of the pusher plate 254 as viewed in FIG. 15 thereby causing the bottom end of such pusher plate as viewed in FIG. 15 to be pushed to the left. Such leftward movement of the bottom end of the pusher plate on the cam 256 will cause such pivot plate to rotate slightly clockwise about its upper end causing the edges of the aperture within which the rail 244 is received to grip such rail so that further rotation of such cam 256 causes the reactive forces of the cam 256 to push to the right relative to the pusher plate 224 thereby causing the shaft 258 to push the bearing plate 260 to the right as viewed in FIG. 15 (to the left as viewed in FIG. 12) to thus draw the work pieces closer together. As the actuating lever 262 is rotated back to its position with the tangential cam surface coextensive with the vertical plane, the bottom end of the pusher plate 254 as viewed in FIG. 15 likewise will be allowed to return to its vertical position but relative translation of the base plate 152 on the rail 224 will be restricted by the fact that the back of the spring 247 maintains the brake lever 282 rotated towards a counterclockwise position abutted against the stop 193 to thereby prevent locking the base plate 152 from moving to the right relative to the rail as viewed in FIG. 15.

Then, after the pusher plate 254 has been pushed slidably to the right on the rail 224 by the compression spring 252 to assume its position in the transverse plane as viewed FIG. 15, abutted against the tangential cam surface 259, it has been moved relative to the rail a sufficient distance so that another stroke might be achieved by again rotating the lever 262 to rotate the axial 258 causing the cam surface 259 to again drive against the pressure plate 254 again moving the base plate 152 to the right on the rail 224.

It will be appreciated that when the base plates 150 and 152 are originally slid approximately toward one another relative to the rail 224 the rubber liners 220 and 222 carried on the proximal end of the base plate 152 will contact the periphery of the hub 188 equidistant above and below the rail 224 as viewed in FIG. 17. This then establishes an initial spacing of about ⅛ of an inch between the rigid proximal end of the plate 152 and the rigid periphery of the hub 188.

The compressibility of such strips 220 and 222 will, however, permit the base plate 152 to be driven on the rail 224 toward the hub 188 to a magnitude an amount proportionate to the compressibility of the rubber and proportional to the forces applied by the press. This then allows for the treated proximal edges of the work pieces to be driven together with a measured amount and with measured forces. In practice, the lever arm 262 is about four inches long to thus provide a substantial mechanical advantage for applying the required magnitude of force through the drive shaft 258 for driving the cam 256 to the degree required for application of the magnitude of forces necessary to force the engaged ends of the work piece together sufficiently to maintain the desired pressure thereon to produce a high quality glue joint.

After adjustment of the clamping apparatus as described above, the respective components to be joined are placed on the upper surface of the base plates 150 and 152. The confronting edges are positioned in contact with one another and the C-clamps 290, 292, 294 and 296 are tightened to press the respective components against the respective top surfaces of the base plates 150 and 152.

It will be appreciated that the optional compressible spacers 220 and 222 will serve to maintain the base plate 152 approximately 1/16 of an inch from the central hub 188 even though the edges of the respective components are in intimate contact. Additionally, the spacers act as a frictional brake on the central hub disks, inhibiting rotation of the lower disk 186 with respect to the upper disk 184, thus tending to resist relative rotation to thereby maintain the relative angular position of the base plates when the predetermined indexing angles are not used. The press may be released so the plate 152 can be freely slid on the rail away from the plate 150 to carry the surmounted components apart to thereby space the adjacent edges of the components apart so ready access can be had thereto. Glue may then be applied to the spaced apart edges of the component and the friction press 232 actuated to release the grip on the rail 224 to free the plate 152 so it can be slid toward the central hub 188. The press may then be operated to incrementally draw the plate 152 along the rail 224 toward the plate 150 as allowed by compression of the spacers 220 and 222 to thereby draw the clamped components toward one another to firmly press the abutting edges together to maintain positive contact and form a high quality glue joint. It will be appreciated that the compressive forces applied to the plate 152 driving it toward the hub 188 (FIG. 17) will be resisted equally by the upper and lower pads 220 and 222 to thus provide a resistive force equally balanced on the top and bottom sides of the rail 224 to thus avoid unwanted canting or racking of the mechanism. The ability to incrementally draw the base plates together with a selected degree of force allows the craftsman to selectively choose the necessary amount of pressure to be applied to the confronting edges of the respective components to thereby prevent application of such high forces as to squeeze the glue out of the joint while allowing for application of further positive compression forces. When the glue joint has cured, the clamps 290, 292, 294 and 296 are released and the joined components removed.

It will be appreciated that several of the major subassemblies comprising this device are comprised of duplicate parts. The prior disclosed embodiment has several odd shaped parts which must be individually manufactured. In the alternative embodiment, duplications in structure of the two base plates, the two hub disks and the four C-clamps enable the fabrication cost of the apparatus to be substantially reduced as compared to the embodiment first described above.

From the foregoing, it will be apparent that the clamp apparatus of the present invention is economical to make, convenient to operate and effective to provide for effective pressing together of odd configured or particularly wide components.

Various modifications and changes may be made with regard to the foregoing detailed description without departing from the spirit of the invention.

What is claimed:

1. Clamping apparatus for pressing the confronting edges of first and second components together and comprising:

first and second base plates formed with upwardly facing support surfaces for supporting the respective said first and second components with said edges confronting one another;

a rail slidably coupled to said second base plate for movement of said second base plate therealong relative to said first base plate;

a hub interposed between said first and second base plates and anchoring one end of said rail and including a pivot to provide for pivoting of said first base plate about said hub so that said first base plate may be pivoted to different selected angles relative to said first base plate;

a press device mounted on said second base plate engaged with said rail and including a pusher plate engageable with said rail to resist travel thereof away from said hub and a one way brake connected between said second base plate and said rail and operative to normally allow free travel of said second base plate toward said hub but operative to engage said rail and lock said second base plate against travel away from said hub and a drive cam mounted on said housing and operative upon oscillation thereof to drive against said pusher and push said second base plate toward said hub and further including a lever arm carried from said cam for oscillation thereof; and a plurality of holders on the respective said first and second base plates for holding said first and second components in fixed position on the respective base plates and said confronting edges disposed in confronting alignment, whereby said second base plate may be positioned on said rail in close spaced relation with said first plate and said first and second components placed on the respective said support surfaces and said holders actuated to fix the respective said components relative to one another and said brake lever released and said second plate then slid along said rail away from said first plate to expose said confronting edges for application of glue thereto and thereafter said second base plate may be slid on said rail toward said first base plate and said lever arm actuated to rotate said cam against said pusher to drive said base plates positively toward one another to press said confronting edges firmly together.

2. Clamping apparatus as set forth in claim 1 wherein:

said hub includes a plurality of disks in stacked relationship.

3. Clamping apparatus as set forth in claim 1 that includes:

a bias device interposed between said hub and one of said base plates to normally maintain said one of said base plates spaced a predetermined distance from said hub but compressible upon application of a predetermined compressive force to compress so said one said base plate can be drawn toward said hub.

4. Clamping apparatus as set forth in claim 1 wherein:

said bias device is in the form of a pair of rubber pads interposed between said hubs and said one base plate and disposed equidistant on opposite sides of a central plane of said one base plate.

5. Clamping apparatus for pressing the confronting edges of first and second components together and comprising:

first and second base plates formed with upwardly facing support surfaces for supporting the respective said first and second components with said edges confronting one another;

a rail slidably coupled to said second base plate for movement of said second base plate therealong relative to said first base plate and anchored on one end to said first base plate;

a press assembly including a housing mounted on said second base plate and including a brake lever mounted from said housing and releasably engageable with said rail to normally restrict movement of said second base plate on said rail away from said first base plate, said press further including a pusher carried on said rail and formed with a drive tab, said pusher operative upon said drive tab being driven in a direction away from said first base plate to grip said rail, a driver engaged with said drive tab and a drive lever arm carried from said second base plate and operable upon rotation thereof in one direction to drive said driver against said drive tab to engage and drive said pusher away from said first base plate to grip said rail so that upon further rotation of said lever in said one direction, said driver will drive said base plate toward said first base plate; and a plurality of holders on the respective said first and second base plates for holding said first and second components in fixed position on the respective base plates and said confronting edges disposed in confronting alignment, whereby said second base plate may be positioned on said rail in close spaced relation with said first plate and said first and second components placed on the respective said support surfaces and said holders actuated to fix the respective said components relative to one another and said brake lever released and said second plate then slid along said rail away from said first base plate to expose said confronting edges for application of glue thereto and thereafter, with said brake line released, said second base plate slid on said rail toward said first base plate, said brake lever released and said lever arm actuated to rotate said cam to engage said pusher to draw said base plates positively toward one another to press said confronting edges firmly together.

6. Clamping apparatus as set forth in claim 5 wherein:

said brake is in the form of a pivotal lever arm carried on one end from said housing configured medially with an aperture for close fit over said rail and terminating at its opposite end in a finger grasp actuating tab; and a bias spring interposed between said pivotal lever arm and said housing to bias said pivotal lever arm to its braking position.

7. Clamping apparatus as set forth in claim 5 wherein:

said pusher is in the form of a plate formed with an aperture closely fitting over said rail and further including a compression spring interposed between said plate and said housing to normally bias said pusher plate away from its rail gripping orientation.

8. Clamping apparatus as set forth in claim 5 wherein:

said second base plate includes a press-receiving cavity surrounding said rail and receiving said housing;

a bearing bore formed in said housing adjacent said pusher wherein said press includes a drive shaft projecting through said bore and formed on its inner extremity with a drive cam engaging said drive tab, and wherein said drive lever is mounted from said drive shaft for being manipulated to oscillate said drive cam to drive said drive tab back and forth.

9. Clamping apparatus as set forth in claim 8 wherein:

said drive lever is substantially four inches long.

10. Clamping apparatus according to claim 5 wherein:

said press assembly includes a housing mounted on said second base plate and including a pusher carried on said rail and formed with a drive tab, said pusher operative upon said drive tab being driven in a direction away from said first base plate to grip said rail, a driver engaged with said drive tab and a drive lever arm carried from said second base plate and operable upon rotation thereof in one direction to drive said driver against said drive tab to engage and drive said pusher away from said first base plate to grip said rail so that upon further rotation of said lever in said one direction, said driver will drive said base plate toward said first base plate.

11. Clamping apparatus as set forth in claim 10 wherein:

said pusher and brake lever are elongated and project transverse of said rail and said press includes a drive cam driven by said lever arm to drive against said pusher, said lever arm projecting upwardly from one side of said second base plate and including on the top end thereof a grip knob.

12. Clamping apparatus for pressing the confronting edges of first and second components together during a gluing process and comprising:

first and second base plates formed with upwardly facing support surfaces for supporting the respective said first and second components with said edges confronting one another;

a rail carried on one end from said first base plate and slidably coupled with said second base plate for movement of said second base plate therealong relative to said first base plate;

a hub interposed between said first and second base plates, including a plurality of disks, said disks stacked concentrically;

pivot means to provide for pivoting of said first base plate about said hub so that said first base plate may be pivoted to different selected angles relative to said first base plate;

a press device mounted on said second base plate engaged with said rail and including a friction latch mechanism coupled to said rail and including a drive cam and a drive lever cooperating with said friction latch mechanism to draw and hold said first and second base plates together;

a plurality of holders on the respective said first and second base plates for holding said first and second components in fixed position on the respective base plates and said confronting edges disposed in confronting alignment, whereby said second base plate may be positioned on said rail in close spaced relation with said first plate and said first and second components placed on the respective said support surfaces and said holders actuated to fix the respective said components relative to one another and said second plate then slid along said rail away from said first plate to expose said confronting edges for application of glue thereto and thereafter said second base plate may be slid on said rail toward said first base plate and press device operated to draw said base plates positively toward one another to press said confronting edges firmly together.

13. Clamping apparatus according to claim 12 wherein:

said first and second base plates have upwardly opening V-grooves in line with said plurality of holders, said V-grooves extending longitudinally for accommodating round stock.

14. Clamping apparatus according to claim 12 further including:

a biasing device including compressible spacers, said spacers interposed between said hub and said second base plate whereby as said press device slides said second base plate within a predetermined distance from said hub said spacers inhibit further hub rotation while maintaining said base plates normally biased a predetermined distance apart.

15. Clamping apparatus according to claim 12 further including:

an indexing mechanism interposed between said disks for selective engagement of said disks to inhibit rotation of said disks relative to one another.

16. Clamping apparatus according to claim 12 wherein:

said hub comprises upper and lower cylindrical disks in stacked relation to one another, said disks pivotally connected axially whereby at least one said disk may rotate freely about said pivot;

a plurality of indexing pockets formed on lower face of said upper disk, said pockets opening toward said lower disk spaced equiangularly proximate the periphery of said upper disk;

an indexing mechanism interposed between said disks including a through bore formed in said lower disk lying along the same radius as said indexing pockets, said bore receiving a coil spring and terminating in a set screw, said coil spring supporting a roller ball received within said bore whereby said coil spring applies force to said roller ball for engaging one of said indexing pockets and maintain said base plates at a relative angle to one another.

* * * * *